United States Patent [19]

Hasslen, III

[11] Patent Number: 4,966,534

[45] Date of Patent: Oct. 30, 1990

[54] SUMP DRAINING APPARATUS

[76] Inventor: John S. Hasslen, III, 1033 Manor Pl., Elk River, Minn. 55330

[21] Appl. No.: 346,396

[22] Filed: May 2, 1989

[51] Int. Cl.[5] ..... F04B 35/04

[52] U.S. Cl. ..... 417/423.3; 417/423.15; 417/424.2

[58] Field of Search ..... 417/423.14, 423.15, 417/423.30, 423.9, 424.1, 424.2

[56] References Cited

U.S. PATENT DOCUMENTS 2,470,563 5/1949 Jennings ..... 417/423.3

4,218,195 8/1980 Shure ..... 417/423.3

*Primary Examiner*—John C. Fox

*Attorney, Agent, or Firm*—Merchant, Gould, Smith, Edell, Welter & Schmidt

[57] ABSTRACT

Sump draining apparatus is disclosed consisting of a cylindrical canister which houses a cylindrically configured pump and motor disposed in axially stacked relation. The top end of the cylindrical canister is sealably closed and the lower end is open to define a liquid inlet. The pump has an inlet spaced from the liquid canister inlet and a pump outlet. A connecting pipe leads from the pump outlet through the closed upper end of the canister to define an external discharge outlet for pumped liquid. Atmospheric pressure forces liquid through the canister inlet upward to the pump inlet, where it is pumped away through the discharge outlet. Air compressed by the incoming liquid is vented through a check valve connected to a vent opening in the top of the canister.

21 Claims, 2 Drawing Sheets

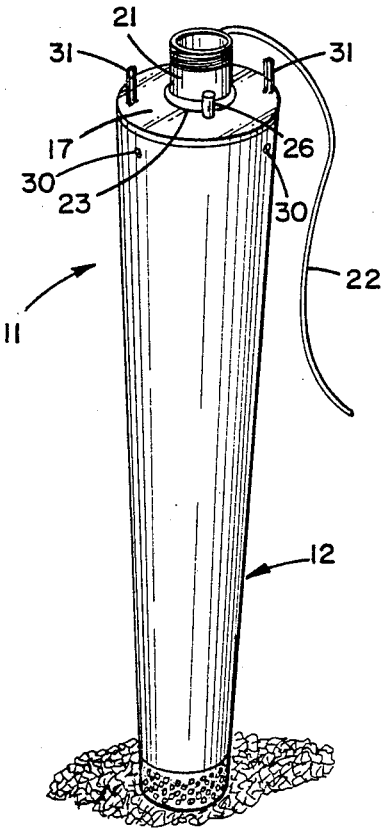
FIG. 1
FIG. 2
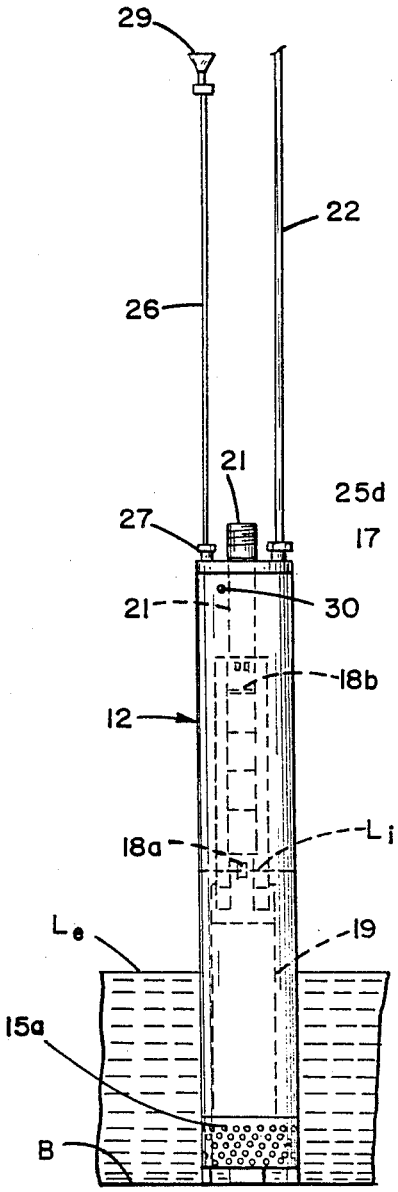

SUMP DRAINING APPARATUS

The invention broadly relates to pumping apparatus and is specifically directed to sump draining apparatus capable of removing hazardous or toxic liquid from spill areas, landfills, leachate sumps, recovery wells and the like.

The presence of toxic and hazardous waste material represents a problem of increasing concern, particularly where such material is found beneath the surface of the ground. The presence of toxic and hazardous liquids in subsurface environments is particularly acute because of the possibility of leaching into water supplies and causing irreparable harm to natural environments.

In some cases, toxic and hazardous liquid waste is created by a particular environment and simply must be controlled by ongoing removal. In others, the liquid waste material finds its way into an environment in which it should not exist, and it must be removed to prevent the problem from spreading as well as to return the environment to its normal state.

An example of the first type of problem is the conventional landfill. Landfills that comply with environmental protection and pollution control regulations consist of a large ground recess the bottom and sides of which are lined with a liquid impermeable material to contain the waste as it is dumped into the recess. An ongoing problem, however, is the seepage of liquid to the bottom of the landfill, which may be waste material in liquid form or simply rain water that seeps through waste in more solid form. If the impermeable liner is punctured or ruptures, the liquid waste flows away from the landfill and creates a toxic or otherwise hazardous environment.

An example of the second type of problem mentioned above is the hydrocarbon spill from gasoline holding tanks at filling stations. These holding tanks are typically installed below the ground, and leaks developed in the tank or in the tank fittings create problems that are not only of a toxic nature but extremely hazardous as well. While it was once believed that such problems exist only in a small percentage of gasoline holding tanks, it is now being found that such problems are relatively commonplace.

Conventional sump draining devices are capable of efficiently removing some types of liquid in certain environments. However, some hazardous and toxic liquids and certain environments cause conventional sump draining apparatus to operate in a less than satisfactory manner.

As an example, conventional devices capable of efficiently removing liquid from larger sump sites are themselves relatively large, particularly in transverse dimension. While size is not necessarily a problem in a purely liquid environment, it becomes a significant problem for environments such as landfills, which include a significant amount of solid waste. It may be necessary to install the sump draining apparatus to depths up to 100 feet to remove the drained liquid, and installing such a device after the landfill is full or partially full is extremely difficult when larger pumping devices are used.

The relatively large size of conventional sump draining apparatus also makes them relatively expensive, particularly where multiple devices are necessary for large sump pits such as landfills.

Another problem with conventional sump draining devices is that they are typically designed to pump water, but not corrosive liquids or liquids which are flammable (e.g., gasoline). In a highly corrosive environment, conventional devices may lose efficiency relatively quickly, followed by a total breakdown. This problem is compounded when the pumping device is located at significant depths and cannot be easily replaced or repaired.

It is possible to overcome the corrosion problem with a stainless steel pump. However, pumps of this type have not been effectively incorporated into sump draining apparatus for use in environments such as landfills and other leachate sumps. Further, some conventional stainless steel pumps have pump inlets that are located at a point remote from the bottom of the pump, which structurally prevents the pump from being positioned at the extreme bottom of the sump pit as is necessary to remove substantially all the liquid.

This invention is directed to sump draining apparatus that overcomes the foregoing problems. To overcome problems encountered with corrosive and flammable liquids, the device utilizes a conventional stainless steel pump. The pump is elongated in configuration but has a relatively small transverse dimension, with the pump inlet intermediate its ends.

The problem of excessive size described above is overcome by utilizing the small transverse dimension of the pump advantageously, and de-emphasizing its longitudinal dimension. This is accomplished by positioning the stainless steel pump longitudinally in an elongated housing or canister of smaller transverse dimension, preferably cylindrical, which defines an internal chamber large enough to receive the pump and permit liquid waste to flow to its inlet, which is internally disposed at a midpoint within the chamber. The upper portion of the canister is sealably closed, and the lowest portion or bottom of the canister defines an inlet to permit the entry of liquid.

In the preferred embodiment, the canister is an elongated cylindrical steel tubular member, relatively small in diameter, and closed at both ends. To permit the entry of liquid into the canister, perforations are formed through the tubular side wall at its extreme lower end. Such perforations act to screen the liquid and to prevent the entry of larger particulate matter.

In the preferred embodiment, the submersible pumping means itself consists of a cylindrically shaped pump and motor disposed in stacked axial relation to permit slidable insertion into the tubular member, with the pump inlet at a midpoint thereon. The pump outlet is at the upper axial end of the pump, and a pipe leads from this outlet through the sealed top end of the canister to provide an external outlet to which a pipe or tube may be connected to discharge the pumped liquid to a remote location. To permit trapped air to be exhausted from the internal chamber of the canister, a vent outlet is provided in the top sealed end of the canister, to which a check valve vent is operably connected. This check valve may be mounted directly on the canister, or it may be remotely disposed through the use of a length of tubing connected between the vent outlet and the check valve.

With the bottom end of the canister placed at the extreme bottom of the sump pit, liquid enters through the side wall perforations at the bottom of the canister. To the extent the level of liquid is above these perforated openings, atmospheric pressure acting on the liquid forces it into the canister and causes it to rise at least to the level of the pump inlet, where it enters and is pumped out through the external pipe to a remote location. When liquid initially enters the canister, air is trapped within the internal chamber and compressed as the liquid level moves upward. The check valve vent enables this compressed air to be evacuated from the internal chamber.

So long as the liquid level in the sump pit is above the canister inlet, atmospheric pressure will continue to force the liquid upwardly to the pump inlet. As soon as the pump has completed its task of reducing the level of liquid below the canister inlet, air enters the canister and liquid pumping stops. The pumping resumes as soon as the liquid accumulates above the canister inlet and is forced by atmospheric pressure up to the pump inlet.

The inventive sump draining apparatus is normally installed in a vertical position, but it may also be installed on its side with the sealed end slightly higher than the inlet end to remove maximum liquid from the sump pit. Because it utilizes a cylindrical pump disposed in a tubular member of relatively small diameter, it can be installed relatively easily even at significant depths by conventional well drilling. Utilizing corrosion resistant materials enables the inventive device to operate efficiently for extended periods of time in different environments.

BRIEF DESCRIPTION OF THE DRAWINGS

FIG. 1 is a perspective view of a sump draining apparatus embodying the invention;

FIG. 2 is a view in side elevation of the sump draining apparatus with internal portions represented by phantom lines.

Figure 3:
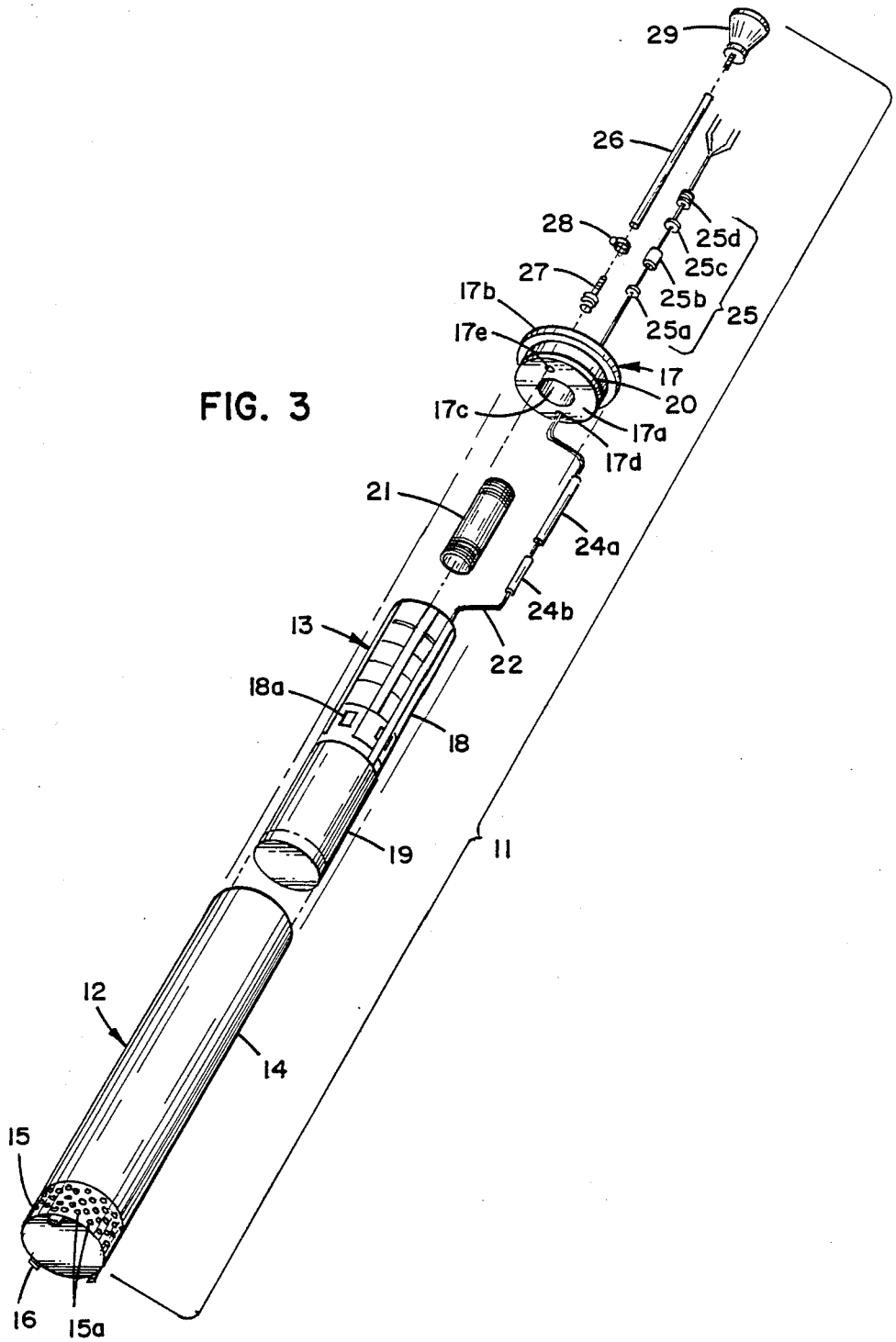
FIG. 3 is an exploded perspective view of the sump draining apparatus.

With reference to the figures, a sump draining apparatus is represented generally by the numeral 11. Apparatus 11 includes an external container or canister 12 that houses a pumping means 13 and other associated components described in further detail below.

Canister 12 is cylindrical in shape in the preferred embodiment, the primary component of which is an imperforate tubular member 14. The tubular member is preferably stainless steel, but it may be formed from corrosion resistant materials such as plastic or fiberglass. Tubular member 14 has a lower end 15 including perforations 15*a* that permit the entry of filtered liquid into the canister 12. The lower axial end of tubular member 14 is closed in the preferred embodiment, but for certain liquids and environments it could be open to permit the direct axial entry of liquid into canister 12.

In the preferred embodiment, the lower end 15 includes three equiangularly spaced supporting legs 16.

As an alternative to the perforations 15*a* in the lower end 15, the canister 12 may include a rigid cylindrical section of wire mesh or screen that performs the same function of permitting the lateral entry of filtered liquid into the canister 12.

The upper end of canister 12 includes a sealing plug 17 having a lower cylindrical projecting portion 17*a* sized to frictionally fit into the upper open end of tubular member 14, and a flange portion 17*b* that rests on the upper axial end of tubular member 14. It is intended that the sealing plug 17 be secured to the canister 12 to prevent the entry of liquid into the canister 12 from the top end. To that end, an O-ring 20 encircling the projecting portion 17*a* acts as a seal with the upper end of tubular member 14, and a plurality of mounting bolts (FIG. 1) extend through the side wall of tubular member 14 and into the projecting portion 17*a* to sealably clamp the plug 17 into place.

The pumping means 13 is also of cylindrical configuration and sized to fit into and be supported by the canister 12. Pumping means 13 is a commercially available electric submersion pump, an example of which is EPG Companies, Model TSP-1-5. This model is constructed of stainless steel to inhibit rust and corrosion. The output flow of such pumping means is 1.25–900 gallons per minute, depending on the pump size motor (power) with which it is equipped.

The pumping means 13 specifically comprises a cylindrically configured pump 18 and an electric pumping motor 19 arranged in axially stacked relation. The pump 18 includes a side inlet 18*a* that is disposed near its bottom end (FIGS. 2 and 3), but which is at an intermediate point with the pump 18 and motor 19 in stacked relation. Pump 18 also includes a top axial discharge outlet 18*b* (FIG. 2). The outlet 18*b* in the preferred embodiment is one to five inches in diameter and is threaded to receive a commensurately sized discharge pipe 21.

Electric pumping motor 19 is of the submergible type and is intended to operate in and below the surface of a liquid environment. An electrical conductor 22 leads from the motor 19 and from the top of the pump 18 for connection to a source of electrical power as discussed in further detail below.

With reference to FIG. 3, sealing plug 17 includes an axial bore 17*c* that is sized to receive the discharge pipe 21. As shown in FIGS. 1 and 2, discharge pipe 21 projects through the bore 17 above the canister 12, and is thus adapted for connection to a conduit for discharging the pump liquid to a remote location. Discharge pipe 21 is sealably connected to the sealing plug 17. This is accomplished by welding in the preferred embodiment (see reference numeral 23 in FIG. 1), although other sealing means may be employed.

The electrical conductor 22 must also be sealed to the plug 17, and to that end includes lengths of heat shrinkable tubular sealing material 24*a*, 24*b*. The shorter length 24*b* is placed over the conductor 22, and the longer length 24*a* slides over the shorter length 24*b*.

A small bore 17*d* formed through sealing plug 17 (FIG. 3) is sized to permit electrical conductor 22 and the lengths 24*a*, 24*b* to project therethrough. In the preferred embodiment, the bore 17*d* is threaded on the outlet side, and an assembly 25 consisting of a gland washer 25*a*, a rubber grommet 25*b*, a second gland washer 25*c* and a gland nut 25*d* serves to seal and clamp the conductor 22 and lengths 24*a*, 24*b* to the sealing plug 17 as well as to provide a strain relief function. The electrical conductor 22 is of sufficient length as to permit remote connection to a source of electrical power in a dry and noncorrosive environment.

Diametrically opposite the bore 17*d* in sealing plug 17 is a similar bore 17*e* that is adapted to receive a vent tube 26. In the preferred embodiment, a barbed connector 27 is threaded into the outlet side of bore 17*e*, and a tube clamp 28 secures the tubing 26 to the connector 27. Other sealed connectors may be used. A vent or relief check valve 29 is sealably secured to the vent tube 26. The check valve 29 may be disposed immediately adjacent the seal plug 17, or it may be located remote from the apparatus 11 through a vent tube 26 of desired length.

In the preferred embodiment, a pair of diametrically opposed lifting hooks 31 (FIG. 1) are secured to the top side of sealing plugs 17 to permit the apparatus 11 to be transported and lowered into place.

When the apparatus 11 is assembled as described hereinabove, the upper end of canister 12 is sealed in its entirety at the sealing plug 17, barbed connector 27, gland nut 25d and discharge pipe 21. As such, liquid cannot enter the canister 12 from the upper end of the apparatus 11 even if the entire apparatus is submerged in liquid. All liquid enters the apparatus from the lower end 15, either through the perforations 15a (or their equivalent if a screen or wire mesh is used) or through the axial opening of lower end 15.

Installation and operation of the apparatus 11 is specifically shown in FIG. 2. In the vertical installation as shown, the canister 12 rests on the bottom B of a tank, reservoir or sump pit having a volume of liquid to be removed, which is at an external liquid level $L_e$. The level $L_e$ may be at various levels relative to the height of the apparatus 11, including total submergence of the apparatus 11. When installed properly, the electrical conductor 22 leads from the sump pit to a remote connection to a source of electrical power, and the check vent 29 is connected either at the sealing plug 17 or at a remote location through the venting tube 26. The discharge pipe 21 is connected to a discharge conduit (not shown) to discharge the pumped liquid at a desired remote location.

The apparatus 11 may be controlled manually or automatically through the use of liquid level sensors. In either case, and with the liquid at level $L_e$ as shown in FIG. 2, the level of liquid within canister 12 will be at the same level as outside the canister 12 when the apparatus 11 is not operating. Before the pumping means 18 can begin, the external liquid level $L_e$ must be at least as high as the pump inlet 18a (internal liquid level $L_i$ as shown) in order for the pump to draw liquid. When the electrical pumping motor 19 is actuated at such time to drive pump 18, a vacuum is drawn within the canister 12 and liquid is drawn into the pump inlet 18a and pumped away. The internal liquid level $L_i$ is maintained at the inlet 18a due to the pressure differential between atmospheric pressure acting on the liquid at level $L_e$ and the partial vacuum created within canister 12. This occurs even though the external level $L_e$ drops below the inlet 18a. The external level $L_e$ will continue to be lowered by the pumping action until it reaches the uppermost perforations 15a. At this point, the pumping means 18 begins to draw air and its operation is stopped.

With the pumping means 18 in an inoperative state, the internal liquid level $L_i$ will rise within canister 12 as the external level $L_e$ begins to rise. As this occurs, air trapped within the canister 12 is compressed. If such air were allowed to remain trapped, air pressure would ultimately become sufficiently high as to prevent the internal liquid level $L_i$ from rising to the pump inlet 18a, and apparatus 11 could not work. However, the provision of the venting tube 26 and check valve 29 allows this air to escape, thus insuring that the internal liquid level $L_i$ can rise to the level of pump inlet 18a for proper operation.

It will also be appreciated that, if the external liquid level $L_e$ is above the pump inlet 18a, the internal liquid level $L_i$ will be at the same level until the apparatus 11 reduces the external level $L_e$ to a point below the pump inlet 18a, and the internal liquid level $L_i$ remains at the level of pump inlet 18a.

Based on the pressure differential between atmospheric pressure acting on the outside apparatus 11 and the partial vacuum existing within the canister due to pumping means 13, the internal liquid level $L_i$ will remain as shown in FIG. 2 until the external liquid level $L_e$ reaches the uppermost perforations 15a. At this point, liquid can no longer be drawn into the pump and level $L_i$ drops to level $L_e$. The pump may be turned off manually at this point in time, or a sensor may accomplish automatic shut off.

Even though the inlet 18a is at a midpoint of the apparatus 11, sealing the upper end of canister 12 and placing the liquid inlet at the lower end of canister 12 enables the apparatus 11 to pump out liquid down to a level just above the bottom B of the sump pit.

What is claimed is:

1. Sump draining apparatus comprising:

sealed canister means having upper and lower portions and defining an internal chamber, the canister means comprising a liquid inlet disposed in the lower portion and a liquid discharge outlet disposed in the upper portion;

liquid pumping means disposed within the internal chamber of the canister means, the liquid pumping means having a pump inlet remote from the liquid inlet of the canister means and a pump outlet;

motor means for driving the pumping means, the motor means being disposed within the canister means between said liquid inlet and said pump inlet;

conduit means establishing liquid communication between the pump outlet and the discharge outlet of the canister means;

and venting means for exhausting air from the internal chamber as the level of liquid rises from the canister means inlet to the pump inlet.

2. The apparatus defined by claim 1, wherein the canister means comprises a tubular member open at both ends, the lower end being open to define said liquid inlet, and means for sealably closing the upper end.

3. The apparatus defined by claim 2, wherein the liquid inlet further comprises perforations formed through the tubular member in said lower portion.

4. The apparatus defined by claim 2, wherein the means for closing the upper end of the tubular member comprises a sealing plug insertable into said upper end in sealing relation therewith.

5. The apparatus defined by claim 4, wherein:

the sealing plug has a bore formed therethrough;

and the conduit means comprises a coupling pipe member projecting through said bore and sealably secured thereto, the coupling pipe member defining said discharge outlet.

6. The apparatus defined by claim 4, wherein the sealing plug is formed with a vent opening therethrough, and the venting means is operatively connected to said vent opening.

7. The apparatus defined by claim 6, wherein the venting means comprises a check valve.

8. The apparatus defined by claim 6, wherein the venting means comprises a check valve and a predetermined length of tubing connected between said vent opening and said check valve.

9. The apparatus defined by claim 4, wherein the pumping means comprises a cylindrically shaped pump and the motor means comprises a cylindrically shaped motor operatively connected thereto, the pump and motor being disposed in axially stacked relation and sized to be slidably inserted into said internal chamber.

10. The apparatus defined by claim 9, wherein:

the motor comprises an electric motor and electrical conductor means adapted for connection to a source of electrical power;

the sealing plug comprises an opening through which the electrical conductor means projects;

and further comprising means for sealably securing the electrical conductor means to the sealing plug.

11. The apparatus defined by claim 1, wherein the pumping means is formed from material that is resistant to corrosion.

12. The apparatus defined by claim 11, wherein the canister means is formed from material that is resistant to corrosion.

13. The apparatus defined by claim 11 or 12, wherein the corrosion resistant material is stainless steel.

14. Sump draining apparatus comprising:

a cylindrical canister having an imperforate cylindrical side wall defining an internal chamber, the canister having a first open end defining a liquid inlet and a second end closed with a liquid outlet formed therethrough;

elongated pumping means having first and second ends disposed within the canister internal chamber with the first and second ends oriented relative to the first and second ends of the canister, the pumping means having a pump inlet disposed at a point intermediate set first and second ends and remote from the canister inlet, and a pump outlet disposed inset second end;

elongated electric motor means for driving the pumping means, the motor means being disposed within the canister in axially stacked relation with the pumping means between said liquid inlet and said pump inlet;

conduit means sealably connected between the pump outlet and the canister outlet;

and venting means for exhausting air from the internal chamber as the level of liquid rises from the canister inlet to the pump inlet.

15. The apparatus defined by claim 14, in which the conduit means comprises a coupling pipe sealably projecting through the canister outlet to define an external liquid discharge outlet.

16. The apparatus defined by claim 14, wherein the venting means comprises a venting outlet formed through the closed second end of the canister and a check valve operatively connected to said vent opening.

17. The apparatus defined by claim 16, which further comprises vent tubing means interconnecting said vent outlet and said check valve.

18. The apparatus defined by claim 14, wherein the canister and pumping means are formed from material that is resistant to corrosion.

19. The apparatus defined by claim 18, wherein said corrosion resistant material is stainless steel.

20. Sump draining apparatus comprising:

sealed canister means comprising a tubular member open at both ends, the lower end defining a liquid inlet;

a sealing plug insertable into the upper end of the tubular member in sealing relation therewith, the sealing plug defining a liquid discharge outlet for the canister means;

liquid pumping means disposed within the internal chamber of the canister means, the liquid pumping means having a pump inlet remote from the liquid inlet of the canister means and a pump outlet;

conduit means establishing liquid communication between the pump outlet and the discharge outlet of the canister means;

and venting means for exhausting air from the internal chamber as the level of liquid rises from the canister means inlet to the pump inlet.

21. Sump draining apparatus comprising:

a cylindrical canister having an imperforate cylindrical side wall defining an internal chamber, the canister having a first open end defining a liquid inlet and a second end closed with a liquid outlet formed therethrough;

elongated pumping means having first and second ends disposed within the canister internal chamber with the first and second ends oriented relative to the first and second ends of the canister;

the pumping means having a pump inlet disposed at a point intermediate set first and second ends and remote from the canister inlet, and a pump outlet disposed inset second end;

conduit means sealably connected between the pump outlet and the canister out;

and venting means for exhausting air from the internal chamber as the level of liquid rises from the canister inlet to the pump inlet, the venting means comprising a venting outlet formed through the closed second end of the canister and a check valve operatively connected to said vent opening.

* * * * *